US005823497A

United States Patent [19]

Weatherhead

[11] Patent Number: 5,823,497

[45] Date of Patent: Oct. 20, 1998

[54] BOX HOLDER

[76] Inventor: Henry A. Weatherhead, 526 Laurel, Wilmette, Ill. 60091

[21] Appl. No.: 752,792

[22] Filed: Nov. 20, 1996

[51] Int. Cl.[6] ..... A47G 1/10

[52] U.S. Cl. ..... 248/316.7

[58] Field of Search ..... 248/316.7, 312.1, 248/905, 684, 229.1, 305, 216.1, 217.3; 24/563, 555, 545, 3.12

[56] References Cited

U.S. PATENT DOCUMENTS

| | | | |
|---|---|---|---|
| 1,828,417 | 10/1931 | Keleher | 248/305 |
| 1,911,934 | 5/1933 | Van Ostrand et al. | 248/305 |
| 2,503,859 | 4/1950 | Webber | 248/311 |
| 2,643,046 | 6/1953 | Humphreys | 229/6 |
| 2,911,175 | 11/1959 | Erie | 248/216 |
| 3,110,467 | 11/1963 | Dube | 248/311 |
| 3,168,276 | 2/1965 | Schneider | 248/316.7 |
| 3,284,041 | 11/1966 | Tjaden | 248/311 |
| 3,292,889 | 12/1966 | Roll | 248/311 |
| 3,395,428 | 8/1968 | Schnabel | 248/905 |
| 3,685,777 | 8/1972 | Dema | 248/205 |
| 3,914,824 | 10/1975 | Purdy | 24/67.9 |
| 4,177,910 | 12/1979 | Gangl | 248/905 |
| 4,279,396 | 7/1981 | Bendock | 248/316.7 |
| 5,573,216 | 11/1996 | Kuroda | 248/316.7 |

*Primary Examiner*—Leslie A. Braun
*Assistant Examiner*—Anita M. King
*Attorney, Agent, or Firm*—Myers & Associates, Ltd.

[57] ABSTRACT

A bracket for suspending a box or container of tissue and the like having a flat base for attachment to a support surface, a bowed joint, and a resiliently mounted armature having a pointed end. A portion of the armature contacts the base in a manner to support the tissue. A stop is provided adjacent the joint to limit the insertion of the tissue on the bracket and to aid in support.

4 Claims, 2 Drawing Sheets

BOX HOLDER

BACKGROUND OF THE INVENTION

1. Field of the Invention

This invention relates in general to support brackets and, more particularly, to support brackets for suspending containers, such as tissue boxes, for convenient access.

2. Summary of the Prior Art

In the past numerous designs for brackets and dispensers have been developed to suspend a container or box at a convenient location to permit access to its contents. Such brackets may support a wide range of containers and boxes such as those containing tissue or other items which are commonly dispensed for use. Prior designs suffer from several shortcomings including a lack of ease of attachment and an overall inefficiency of design. Some brackets fail to adequately support a dispensing container in a manner to securely retain the container without being ripped or torn from its securement position. Other brackets are unsightly in appearance and are relatively expensive to manufacture. One bracket for containing a facial tissue box is disclosed in U.S. Pat. No. 3,110,467 to Dube. The hook disclosed in Dube is relatively difficult to attach to surfaces and fails to support the tissue box in an optimum manner to prevent ripping as facial tissue is dispensed by the user. Other tissue box supports suffering from similar shortcomings as the foregoing patent in Dube are disclosed in U.S. Pat. No. 3,284,041 to Tjaden, U.S. Pat. No. 3,685,777 to Dema, and U.S. Pat. No. 2,503,859 to Webber. Accordingly, it is desirable to provide an economical bracket for retaining container boxes and the like in a manner to prevent damage to the box during dispensing and having the capability of being attached in a plurality of orientations for ease of use.

SUMMARY OF THE INVENTION

It is therefore an objective of this invention to provide an economical bracket which is capable of effectively retaining a box or other container in a plurality of orientations and provide optimum access to the product being dispensed. The invention of the application provides means of suspension of a box in a manner which absorbs forces caused when tissue or other material is removed. The bracket herein disclosed is further capable of being readily attached to a support surface and allows the container to be securely supported until its contents are exhausted. The improved design of the bracket of the invention further includes a configuration that only minimally projects from the support surface so as not to inflict injury or damage to the clothing of the person coming in the vicinity of its structure.

DESCRIPTION OF THE PREFERRED EMBODIMENT

Figure 1:
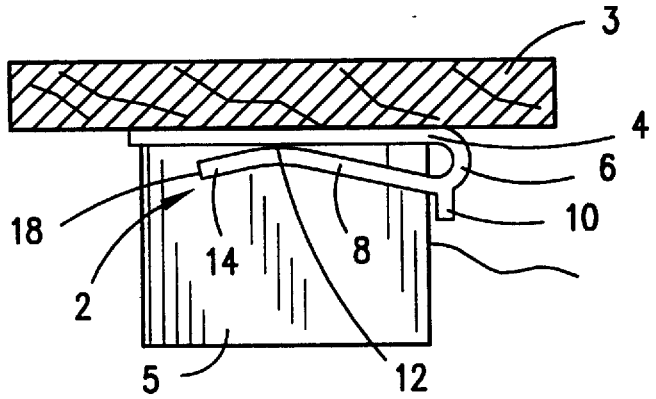
FIG. 1 is a side elevational view of the bracket of the invention shown in a horizontal orientation beneath a support surface.
Figure 2:
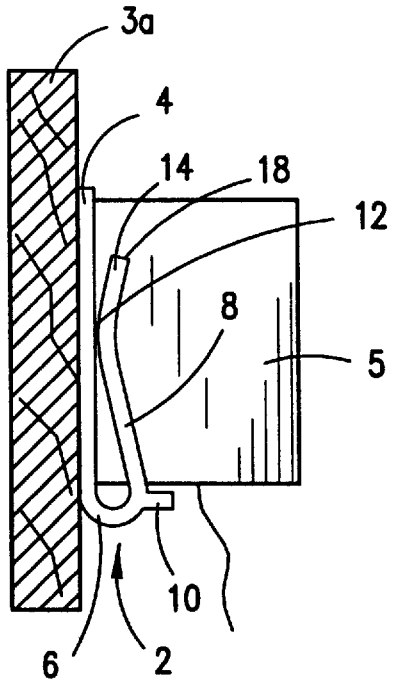
FIG. 2 is a side elevational view of the box holder of the invention being retained on a vertical surface with a box having its contents being directed downward.
Figure 3:
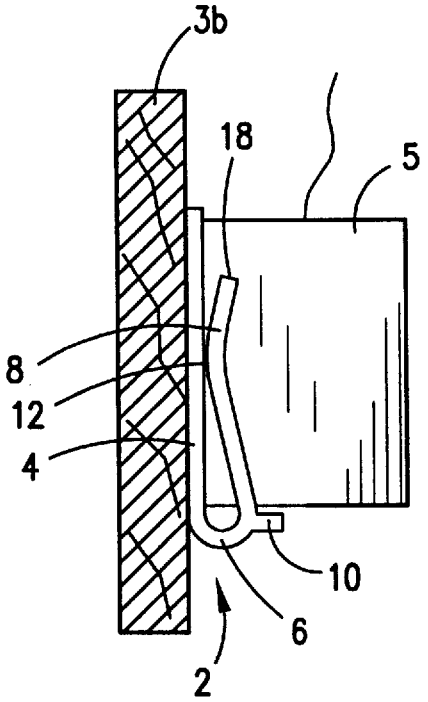
FIG. 3 is a side elevational view of the bracket of the invention similar to the orientation of FIG. 2 with the contents of the box being suspended having its contents being directed upward.
Figure 4:
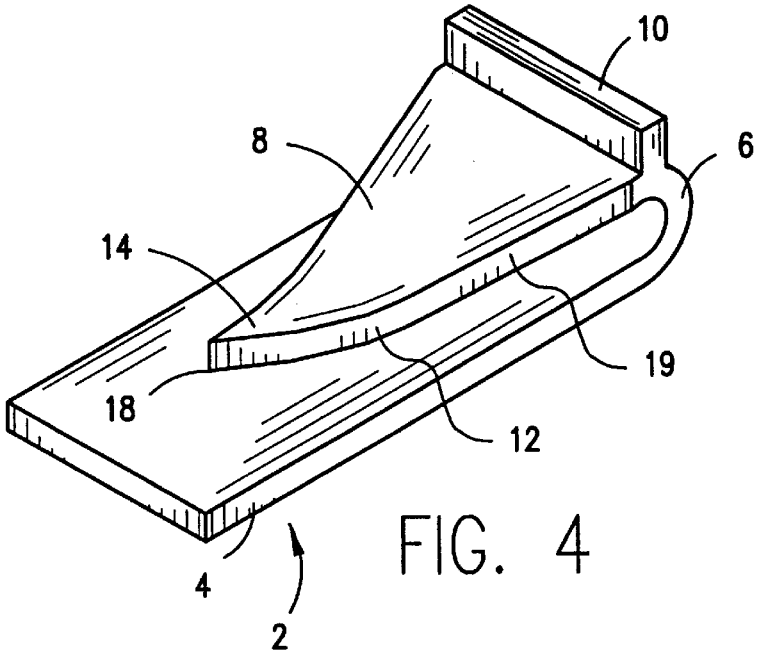
FIG. 4 is front perspective view of the bracket of the invention as shown in FIGS. 1, 2, and 3.

Referring to FIG. 4, there is illustrated the box holder of the invention shown as bracket 2. The bracket 2 includes a base 4 having a flat configuration which is arranged to be attached to a support surface, such as surfaces 3, 3*a* and 3*b* shown respectively in FIGS. 1, 2, and 3. The bracket 2 can be constructed from a plastic or resilient metal for suspending a box or container 5 of facial tissue or similar product for convenient dispensing of its contents. The base 4 is capable of being mounted on any type of surface, such as on a cabinet, wall and the like through the use of an adhesive, nails, screws, or other means (not shown). The length of the flat base 4 is desirably longer than the box 5 being supported as seen in FIGS. 1, 2, and 3. A curved joint section 6 is integrally formed at one end of base 4 and connects the base 4 to an upper armature or tongue 8. A vertical flange 10 projects above the arm 8 and serves as a stop for the box 5 during its insertion for attachment in a manner to be described.

As best seen in FIGS. 1, 2, and 3, the arm 8 has its maximum separation from base 4 adjacent its connection at joint section 6 and projects inwardly towards the support surface 4 at an intermediate section 12 at which it forms a bowed or curved configuration. The bowed-like relation of the mounting of the arm 8 to the base 4 insures that the arm possesses a resiliency for adequate securement of the box 5 to be suspended. The intermediate section 12 of arm 8 is disposed in near contact with the surface of base 4. The end section 14 of the arm 8 projects upward and is provided with a pointed end 18 for ease of insertion of the box 5 into the bracket 2 with a wall of the box being positioned between base 4 and arm 8. As seen in FIG. 4, the arm 8 includes edges 19 having a generally inwardly tapered shape terminating with the pointed end 18.

In attachment of the tissue box 5 and the like, the container is slid along the attached base 4 and is pierced by the pointed end 18 until the box is slid through substantially the length of the arm 8 up to the stop 10. The base 4 is longer and is as wide as the tissue box 5 being retained to provide the largest surface for attachment and for absorption of the weight and other forces applied to the box 5 during use. The curved configuration of the arm 8 enables the intermediate portion 12 to snugly squeeze the tissue box between it and base 4 at approximately the mid-point of the box 5 so that the weight of the box 5 and its contents are primarily supported at this point. It should be further noted that the width of the bracket at the joint 6 is approximately as wide as the inner dimension of the top of the tissue box 5 so that any weight that is supported at the point where the top of box 5 touches arm 8 will be distributed over the entire width of the box. If the bracket 2 is made without stop 10 as a modification, particularly useful in horizontal orientation of the bracket, the forces caused by the removal of the tissue will be absorbed along the entire wall of the inside surface of joint 6 joining arm 8 and base 4.

In FIG. 1, the tissue box 5 is shown suspended beneath the support surface 3, such as under a desk, under a cabinet, under a shelf, and the like. In FIG. 2, the bracket 2 is shown suspended on surface 3 with container 5 with its contents opening downward. In FIG. 3, the container 5 is shown suspended on surface 3*b* with its contents being directed upward.

Figure 6:
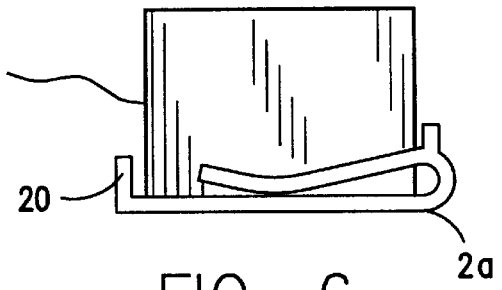
FIG. 6 is a side elevational view of a second embodiment of the bracket the invention.
Figure 5:
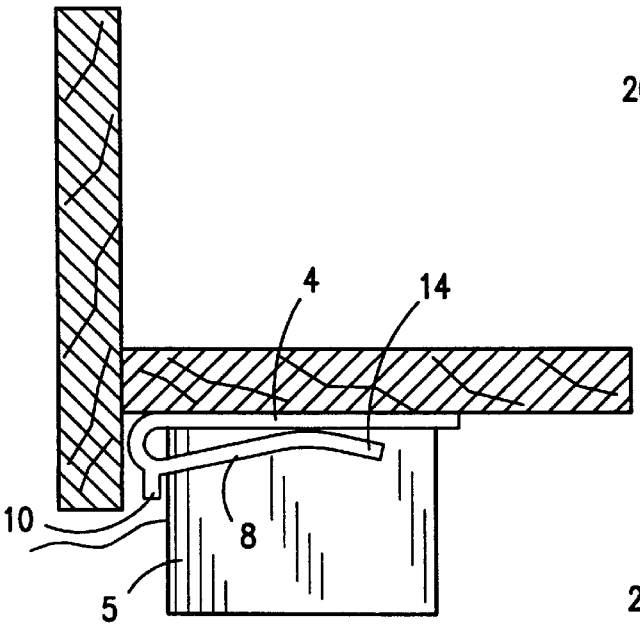
FIG. 5 is a side elevational view of a modified reverse mounting of the container at intersecting surfaces.
Figure 7:
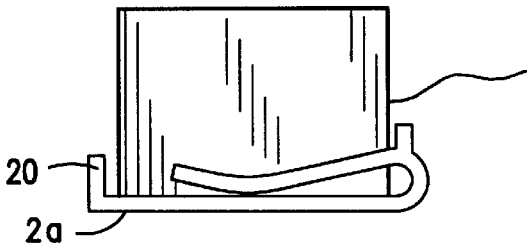
FIG. 7 is a side elevational view of the second embodiment of FIG. 6 supporting the container in a reverse orientation.

Referring to FIG. 6 and 7, the bracket of the invention can be modified with the brackets 2*a* having an additional stop 20. Otherwise, bracket 2*a* is virtually identical as bracket 2 as previously described. The structure of bracket 2*a* in FIGS. 6 and 7 is identical except with the contents of box 5 opening outward in opposite directions.

What is claimed is:

1. A bracket adapted to be mounted on a bracket support surface for suspending a side of container, comprising:

a base structure adapted to be attached to the bracket support surface, said base structure comprising a flat plate part, an arm part being connected to said flat plate part and having a lower surface lying in confrontation to said base flat part, said arm part being resiliently retained to said flat plate part and having a free end part disposed over said flat plate portion for attachment to the container side, said arm part having an arm portion adjacent the free end part in at least near contact with said base flat part for retention of the container, said base structure having a transverse section for integrally attaching said arm part (8) to said flat plate part, said arm part having an upper surface, an upward flange projecting from said upper surface, and said upward flange being positioned adjacent said transverse section adapted to form a stop with said container, and wherein said free end part of said arm has a tapered configuration terminating with a pointed end for insertion into the container.

2. The bracket according to claim 1 wherein said arm part has a maximum separation from said base plate part adjacent said transverse section.

3. The bracket according to claim 1 and said free end part of said arm part projects outwardly from said base plate part.

4. The bracket according to claim 1 and said transverse section being a curved bowed section.

* * * * *